US008980165B2

(12) United States Patent
Simoes et al.

(10) Patent No.: US 8,980,165 B2
(45) Date of Patent: Mar. 17, 2015

(54) TUYERE STOCK ARRANGEMENT OF A BLAST FURNACE

(75) Inventors: Jean-Paul Simoes, Walferdange (LU); Paul Tockert, Berbourg (LU); Lionel Hausemer, Sandweiler (LU)

(73) Assignee: Paul Wurth S.A., Luxembourg (LU)

( * ) Notice: Subject to any disclaimer, the term of this patent is extended or adjusted under 35 U.S.C. 154(b) by 207 days.

(21) Appl. No.: 13/698,876

(22) PCT Filed: May 23, 2011

(86) PCT No.: PCT/EP2011/058378
§ 371 (c)(1),
(2), (4) Date: Nov. 19, 2012

(87) PCT Pub. No.: WO2011/147781
PCT Pub. Date: Dec. 1, 2011

(65) Prior Publication Data

US 2013/0061786 A1 Mar. 14, 2013

(30) Foreign Application Priority Data

May 26, 2010 (LU) ..... 91691

(51) Int. Cl.

| | |
|---|---|
| ***C21B 7/16*** | (2006.01) |
| ***F27B 1/16*** | (2006.01) |
| ***C21B 5/00*** | (2006.01) |
| ***F27D 3/18*** | (2006.01) |

(52) U.S. Cl.
CPC . *F27B 1/16* (2013.01); *C21B 5/001* (2013.01); *C21B 7/163* (2013.01); *F27D 3/18* (2013.01)
USPC ..... 266/267

(58) Field of Classification Search
CPC ..... C21B 7/16; C21B 7/163
USPC ..... 266/265, 266, 267, 268, 47
See application file for complete search history.

(56) References Cited

U.S. PATENT DOCUMENTS 4,759,532 A * 7/1988 Illuminati ..... 266/182
5,333,840 A * 8/1994 Skold et al. ..... 266/47

(Continued)

FOREIGN PATENT DOCUMENTS

EP 0447908 A1 9/1991
JP 62192509 A 8/1987

(Continued)

OTHER PUBLICATIONS

International Search Report; International Application No. PCT/EP2011/058378; International Application Filing Date May 23, 2011; Mail Date Sep. 19, 2011.

(Continued)

*Primary Examiner* — Scott Kastler
(74) *Attorney, Agent, or Firm* — Cantor Colburn LLP

(57) ABSTRACT

Tuyere stock arrangement of a blast furnace includes a tuyere body configured for installation in a shaft furnace wall. The tuyere body includes a front face facing an interior of the shaft furnace and an opposite rear face and a tuyere channel extending between the rear and front faces (24). The stock arrangement includes a blowpipe between the rear face and a hot blast air supply system, the blowpipe having a front portion connecting to the tuyere body and an opposite rear portion connecting to the hot blast air supply system. A fuel injection lance is arranged through the tuyere body and feeds fuel into the shaft furnace. A gas injection lance feeds an oxidizing gas to the shaft furnace and is arranged in the rear portion of the blowpipe to feed oxidizing gas into a central portion of a stream of hot blast air fed through the blowpipe.

8 Claims, 3 Drawing Sheets

(56) References Cited

U.S. PATENT DOCUMENTS

| | | | | |
|---|---|---|---|---|
| 6,053,962 | A | 4/2000 | Ariyama et al. | |
| 2012/0007291 | A1* | 1/2012 | Goedert et al. | 266/47 |
| 2013/0061786 | A1* | 3/2013 | Simoes et al. | 110/182.5 |

FOREIGN PATENT DOCUMENTS

| | | | |
|---|---|---|---|
| JP | 5112806 | A | 5/1993 |
| JP | 11343511 | A | 12/1999 |
| LU | 88004 | A1 | 6/1992 |
| WO | 2009141419 | A1 | 11/2009 |

OTHER PUBLICATIONS

Written Opinion; nternational Application No. PCT/EP2011/058378; International Application Filing Date May 23, 2011; Mail Date Sep. 19, 2011.

* cited by examiner

TUYERE STOCK ARRANGEMENT OF A BLAST FURNACE

TECHNICAL FIELD

The present invention generally relates to a novel tuyere stock arrangement of a blast furnace, in particular for feeding hot blast air into the blast furnace, while also feeding fuel and oxygen to the blast furnace through the tuyere stock arrangement.

BACKGROUND ART

The injection of auxiliary fuels (natural gas, oil, coal or other carbonaceous materials) into the blast furnace has been driven by economic factors. Mid of last century, oil was, due to its low price, the preferred auxiliary fuel to reduce the consumption of expensive metallurgical coking coals and to avoid capital expenditures linked to the expansion of the coke-making plant.

A first major re-evaluation considering auxiliary fuel injection had to be done due to the oil crisis in the 1970s. Although pulverized coal injection had been practiced in some blast furnaces since the early 1960s, it was only in the 1980s that the interest for PCI escalated due to the oil price shocks.

A second, more recent re-evaluation of auxiliary fuel injected into the blast furnace is caused by the drastically increasing energy prices, including the natural gas price and the decoupled price evolution for non-coking coals. Due to the higher availability, it is much probable that the non-coking coal prices will, also in future, remain lower than those for oil and natural gas.

It is well known that the injection of fuel, such as e.g. pulverized or granular coal, into the hot-air blast, which is blown through a plurality of tuyeres into a lower portion of the blast furnace, has many advantages. In particular, the injection of coal decreases the overall cost of produced hot metal, not only through the replacement of coke, but also through an increased productivity and the possibility of a prompt control of the blast furnace operation.

The injection of pulverized or granular coal is performed conventionally by means of a fuel injection lance into the hot-air blast at a certain distance upstream from the tuyere end opening into the furnace. In other words, the coal is injected through the hot-air passage in the tuyere. The coal fed through the fuel injection lance is in suspension in a transport gas.

Regarding all the economical and ecological advantages of coal injection, the injection levels will continue to rise. A major concern related to higher injection levels is the combustion behavior of the coal in the blast furnace. Inefficient coal combustion in the raceway will result in unburned coal particles obstructing the permeability within the void spaces of the burden and thus causing a degraded blast furnace operation leading to production losses.

In order to minimize the char load into the blast furnace the coal combustion within the raceway has to be maximized. This can be done by an improved mixing of the well dispersed pulverized coal with the oxygen enriched hot gas. As the residence time of the coal particles in the raceway is only in the range of a few milliseconds, it is important to reach the ignition point very rapidly.

The ignition point of a specific coal is dependent of the coal type and its size distribution, and of parameters like for instance the oxygen enrichment as well as the hot blast, the oxygen, the coal transport gas and the coal temperature.

As more fuel is fed into the blast furnace, the quantity of oxidizing gas has to be increased in order to warrant a correct burning of the additional fuel. Typically, the additional oxidizing gas is fed through a separate gas injection lance having its gas outlet in the vicinity of the outlet of the fuel injection lance. Alternatively, the combined injection of fuel and oxidizing gas has been suggested e.g. in EP 0 447 908, wherein the injection is performed through a coaxial lance, wherein an outer tube is arranged surrounding an inner tube. The inner tube forms a separation wall between the oxidizing gas and the fuel until both reach an outlet nozzle of the lance. Such coaxial injection lances are often referred to as oxycoal lances. In EP 0 447 908, oxidizing gas is conveyed in the outer tube and fuel is conveyed in the inner tube.

A disadvantage of these systems is that the oxidizing gas fed through the separate gas injection lance or the oxycoal lance is cold. Consequently, when the oxidizing gas meets the fuel, ignition and combustion of the fuel does not take place until an ignition temperature of a mixture of oxidizing gas and fuel has been reached.

It has also been suggested to increase the oxygen content in the hot blast air by increasing the oxygen content in the cold blast air before the latter is heated up in a hot stove. By feeding additional oxidizing gas through the hot stove, the oxidizing gas is heated and can be delivered via the blowpipe to the fuel at a higher temperature. However, high oxygen concentration in the hot blast air may lead to seals and other metallic parts being burnt. The risk of fire increases with higher oxygen concentrations. Typically, the oxygen flow rates in the hot blast air are therefore limited to about 30%. In order to improve the combustion conditions of the fuel, higher oxygen concentrations may however be desired.

BRIEF SUMMARY

The invention provides an improved tuyere stock arrangement of a blast furnace.

The present invention proposes a tuyere stock arrangement of a shaft furnace, the tuyere stock arrangement comprising a tuyere body configured for installation in a shaft furnace wall the tuyere body comprising a front face facing an interior of the shaft furnace and an opposite rear face, a tuyere channel extending from the rear face to the front face. The tuyere stock arrangement further comprises a blowpipe connected between the rear face of the tuyere body and a hot blast air supply system, the blowpipe having a front portion connecting to the tuyere body and an opposite rear portion connecting to the hot blast air supply system. A fuel injection lance is provided for feeding fuel into the shaft furnace, the fuel injection lance being arranged through the tuyere body, and a gas injection lance is provided for feeding an oxidizing gas to the shaft furnace. According to an important aspect of the invention, the gas injection lance is arranged in the rear portion of the blowpipe, the gas injection lance being arranged in such a way as to feed the oxidizing gas into a central portion of a stream of hot blast air fed through the blowpipe.

By feeding the oxidizing gas into the hot blast air in a rear portion of the blowpipe, the oxidizing gas is in contact with the hot blast air as it travels through the blowpipe towards the tuyere body. Through this contact, the oxidizing gas picks up heat from the hot blast air, thereby increasing its temperature. Oxidizing gas which has been heated to a higher temperature is thus brought into contact with the injected fuel, thereby improving the burning conditions.

The higher temperatures of the oxidizing gas are of particular interest if coal is being used as fuel. Indeed, although coal has the advantage of providing high coke replacement ratio, it has the disadvantage of being hard to ignite. The hotter oxidizing gas however improves the ignition conditions of the coal/fuel mixture and also ensures an easy and good combustion thereof.

As indicated in the introduction, higher oxygen concentrations in the hot blast air may lead to seals and other metallic parts being burnt and increase the risk of fire. As the oxidizing gas is, according to the present invention, injected into the rear portion of the blowpipe, it follows that this risk is limited to the blowpipe, i.e. the portion of the arrangement downstream of the point of injection of the oxidizing gas. This risk does not exist in the portion of the arrangement upstream of the point of injection of the oxidizing gas comprising amongst others the hot stove and the bustle pipe. In the blowpipe, the risk of damage to seals and other metallic parts is reduced because direct contact of the oxidizing gas with the blowpipe walls is reduced. Indeed, the oxidizing gas is centrally fed into the hot blast air. In other words, the hot blast air surrounds the oxidizing gas as it travels towards the blast furnace. As the hot blast air advantageously has higher viscosity than the oxidizing gas, the oxidizing gas injected into a central portion of the hot blast air tends to remain concentrated in the center, i.e. away from the blowpipe walls.

The present tuyere stock arrangement allows the use of very high volatile matter (VM) coals as fuel. Indeed, such high VM coals require high oxygen content in order to maintain a sufficient Raceway Adiabatic Flame Temperature (RAFT). The additional oxygen tends to increase the RAFT, whereas cracking energy of coal combustion tends to lower the RAFT. As high VM coals have higher cracking energy, an increased concentration of oxygen is necessary to maintain the RAFT. Due to the present invention, the oxygen content can be increased, thereby allowing the use of high VM coals.

The hot blast air supply system may comprise a hot blast bustle pipe and a downleg for connecting to the blowpipe; and the blowpipe may comprise an elbow at its rear portion, the elbow connecting the blowpipe to the downleg. Advantageously, the gas injection lance is then arranged in the elbow. Such an elbow may comprise an extension in axial alignment with the blowpipe, a peep sight being arranged at an end portion of the extension. Arranging the gas injection lance in the elbow of a tuyere stock arrangement allows for the oxidizing gas injection to take place at a point furthest away from the tuyere body, thereby allowing for a higher residence time of the oxidizing gas in the hot blast air, thus maximizing the heat pickup from the hot blast air. Also, the path from the elbow to the point where fuel is injected is generally straight, thereby keeping the oxidizing gas concentrated in the center of the hot blast air and avoiding that the oxidizing gas excessively mixes with the hot blast air.

The gas injection lance is preferably arranged in such a way as not to obstruct a visual path between the peep sight and the tuyere body. Other arrangements should however not be excluded.

According to one embodiment of the invention, gas injection lance is arranged parallel to and coaxial with a visual path between the peep sight, wherein the visual path passes through the gas injection lance. The gas injection lance comprises a lateral gas inlet for feeding oxidizing gas to the gas injection lance. By arranging the gas injection lance in such a way, the oxidizing gas fed into the gas injection lance passes directly in front of the window of the peep sight, thereby keeping the window free from condensation and dust. Indeed, in state of the art installations, hot blast air is allowed to flow from the elbow up to the window of the peep sight. Due to the higher temperature of the hot blast air, condensation builds up on the window of the peep sight. Furthermore, dust particles contained in the hot blast air may be deposited on the window of the peep sight, thereby obstructing the view through the peep sight. The present arrangement of the gas injection lance allows colder oxidizing gas to be fed past the window of the peep sight, thereby avoiding such condensation and dust deposits.

According to one embodiment of the invention, the fuel injection lance is arranged through the tuyere body so as to feed fuel into the tuyere channel, the fuel injection lance opening into a sidewall of the tuyere channel. This allows the oxidizing gas to enter into contact with the fuel within the raceway. The combustion of the fuel is carried out within the raceway, thereby minimizing the feeding of unburnt fuel into the blast furnace.

According to another embodiment of the invention, the fuel injection lance is arranged through the tuyere body so as to feed fuel into the blast furnace, the fuel injection lance opening into the front face of the tuyere body. Such an arrangement may be of the type disclosed in applicant's co-pending application LU 91 543 filed on Mar. 24, 2009, herewith incorporated by reference, wherein an injection lance is arranged in a lance passage formed in the tuyere body, the lance passage being arranged between an inner wall and an outer wall of the tuyere body and extending from the rear face to the front face, the lance passage opening into the front face of the tuyere body. By arranging the injection lance in such a lance passage through the tuyere body, the injection lance is not exposed to the heat from the hot blast air blown through the blowpipe and the tuyere. Consequently, the injection lance is not at risk of being attacked by the hot blast air.

The fuel fed through the fuel injection lance is preferably pulverized or granular coal. Granulated plastics, animal grease or flour, liquid fuel, natural gas or shredded tires may however also be used.

Advantageously, the oxidizing gas fed through the gas injection lance is a gas having high oxygen content; preferably, the oxidizing gas is essentially pure oxygen. In the context of the present application, a gas having high oxygen content will be a gas with an oxygen content of at least 80% and pure oxygen is a gas with an oxygen content of at least 95%.

The hot blast air fed to the blowpipe is preferably at a temperature between 1000 and 1300° C. The oxidizing gas can, when reaching the tuyere body, be at a temperature of a few hundred degrees centigrade.

BRIEF DESCRIPTION OF THE DRAWINGS

A preferred embodiment of the invention will now be described, by way of example, with reference to the accompanying drawing, in which.

DETAILED DESCRIPTION

Figure 1:
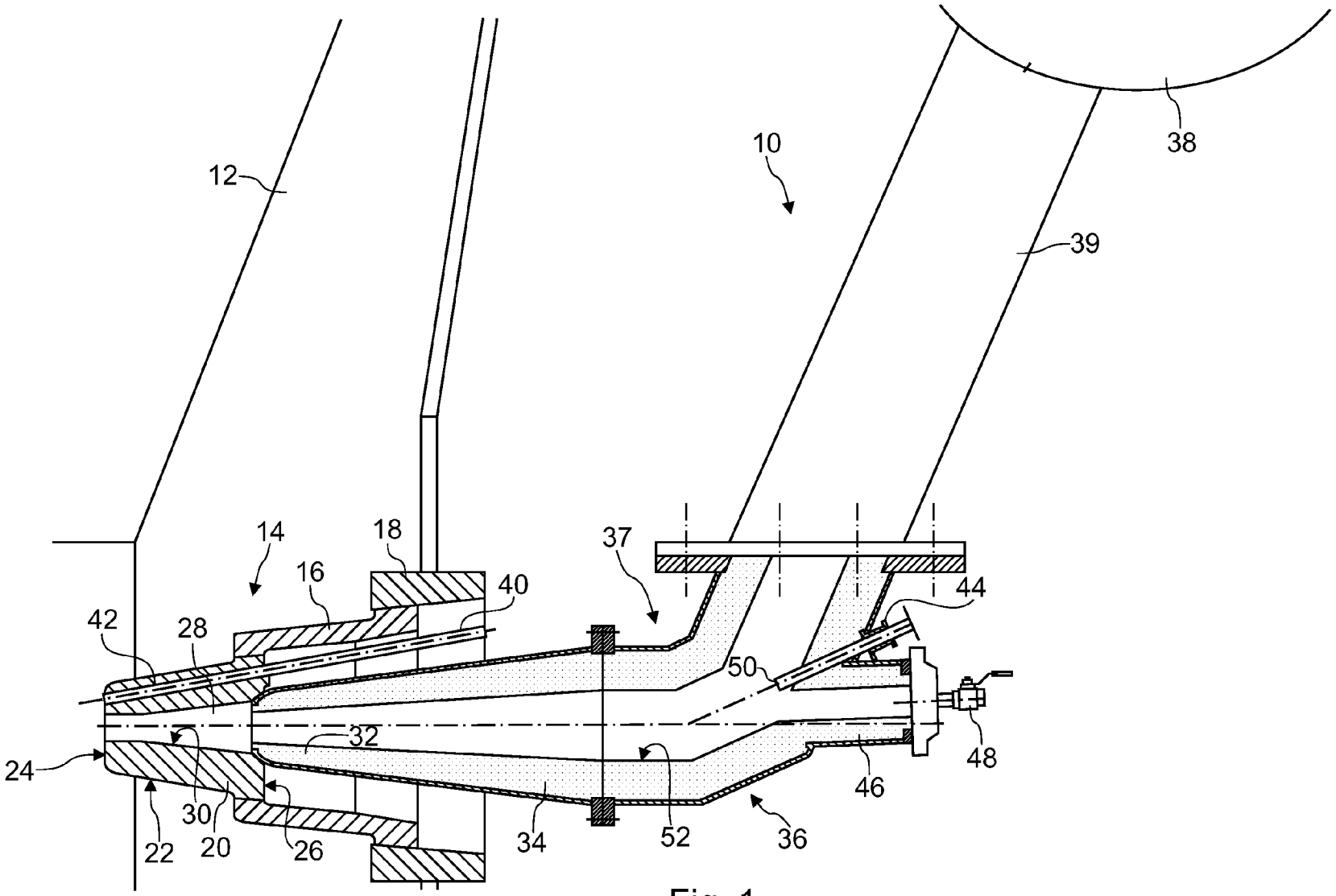
FIG. 1 is a schematic cut through a tuyere stock arrangement according to one embodiment of the present invention.

FIG. 1 shows a tuyere stock arrangement 10 for feeding hot blast air through a furnace wall 12. The tuyere stock arrangement 10 comprises a tuyere 14 arranged in the furnace wall 12. The tuyere 14 is maintained in position by a tuyere cooler 16 and a tuyere cooler holder 18.

The tuyere 14 has a tuyere body 20 with an outer wall 22, a front face 24 and an opposite rear face 26. A tuyere channel 28 is centrally arranged through the tuyere body 20 and extends from the rear face 26 to the front face 24. The tuyere channel 28 forms an inner wall 30 in the tuyere body 20. The rear face 26 of the tuyere 14 is configured to receive a front portion 32 of a blowpipe 34, which is connected, with an opposite rear portion 36, generally in the form of an elbow 37, to a hot blast air feeding system represented here by a bustle pipe 38 and a downleg 39. The blowpipe 34 is configured and arranged so as to feed hot blast air from the bustle pipe 38 to the tuyere channel 28 for injection into the blast furnace.

Furthermore, a fuel injection lance 40 is provided for feeding a fuel, generally pulverized or granular coal, into the blast furnace at the tuyere level. Due to the injection of the fuel into the blast furnace the amount of coke fed into the furnace can be reduced. As fuel, such as e.g. coal, is generally cheaper than coke, this leads to a reduction in running costs of the blast furnace.

According to the embodiment shown in FIG. 1, the fuel injection lance 40 is arranged in a lance passage 42 formed in the tuyere body 20. Such a lance passage 42 is arranged between the inner wall 30 and the outer wall 22 of the tuyere body 20 and extends from the rear face 26 to the front face 24. The lance passage 42 thereby opens into the front face 24 of the tuyere body 20. The feeding of the fuel injection lance 40 through the lance passage 42 in the tuyere body 20 allows preventing the fuel coming into contact with the hot blast air within the tuyere stock arrangement. Such an arrangement of the fuel injection lance 40 keeps the latter protected from the high temperatures of the hot blast air and therefore allows increasing its lifetime. Further details and advantages of the arrangement of the fuel injection lance 40 in the lance passage 42 can be found in applicant's co-pending application LU 91 543.

In order to promote the combustion of the fuel, gas injection lances are generally provided for feeding oxidizing gas, such as oxygen, to the fuel. Such a gas injection lance may be in the form of a separate lance or integrated within a fuel injection lance. Such integrated lances are coaxial lances comprising two concentric pipes for carrying the fuel and the oxidizing gas while keeping them apart until they reach the tip of the lance.

Contrary to prior art systems, where gas injection lances are arranged to feed oxidizing gas directly or at least in proximity to the injected fuel, the inventors have found it advantageous to provide a separate gas injection lance 44 arranged in the elbow 37 of the blowpipe 34. Such a gas injection lance 44 is arranged so as to feed oxidizing gas centrally into the stream of hot blast air being fed through the blowpipe 34. The hot blast air surrounds the oxidizing gas as it travels through the blowpipe 34 towards the tuyere 20. By injecting the oxidizing gas into the hot blast air in the elbow 37 of the blowpipe 34, the oxidizing gas is in fact injected in a location furthest away from the tuyere 20, but still in axial alignment with the blowpipe 34. As a consequence, the residence time of the oxidizing gas in the hot blast air is maximized, which in turn maximizes the heat pickup from the surrounding hot blast air. The axial alignment of the path of oxidizing gas with the blowpipe is important so as to keep the oxidizing gas concentrated centrally in the flow of hot blast air, i.e. to minimize undesired mixing of the oxidizing gas in the hot blast air. Indeed, a bend in the flow path causes turbulences that force the two gasses to mix.

The elbow 37 of the blowpipe 34 generally comprises an extension 46 in axial alignment with the blowpipe 34. A peep sight 48 is generally arranged at the end of the extension 46. Such a peep sight 48 may be used to look down through the blowpipe 34 into the tuyere channel 28 and observe the burning of a flame at the tip of the tuyere 20. The burning conditions in the blast furnace may be monitored through the peep sight 48. In some circumstances, the outlet of the tuyere 20 may become blocked. Such blockage can also be detected by looking through the peep sight 48.

According to the embodiment shown in FIG. 1, the gas injection lance 44 is inserted into the elbow 37 from above the extension 46. An outlet end 50 of the gas injection lance 44 is centrally arranged in a gas passage 52 through the blowpipe 34. The orientation of the gas injection lance 44 is such that at the outlet end 50, the flow direction of the oxidizing gas is parallel to, preferably coaxial with, the flow direction of the hot blast air.

Figure 2:
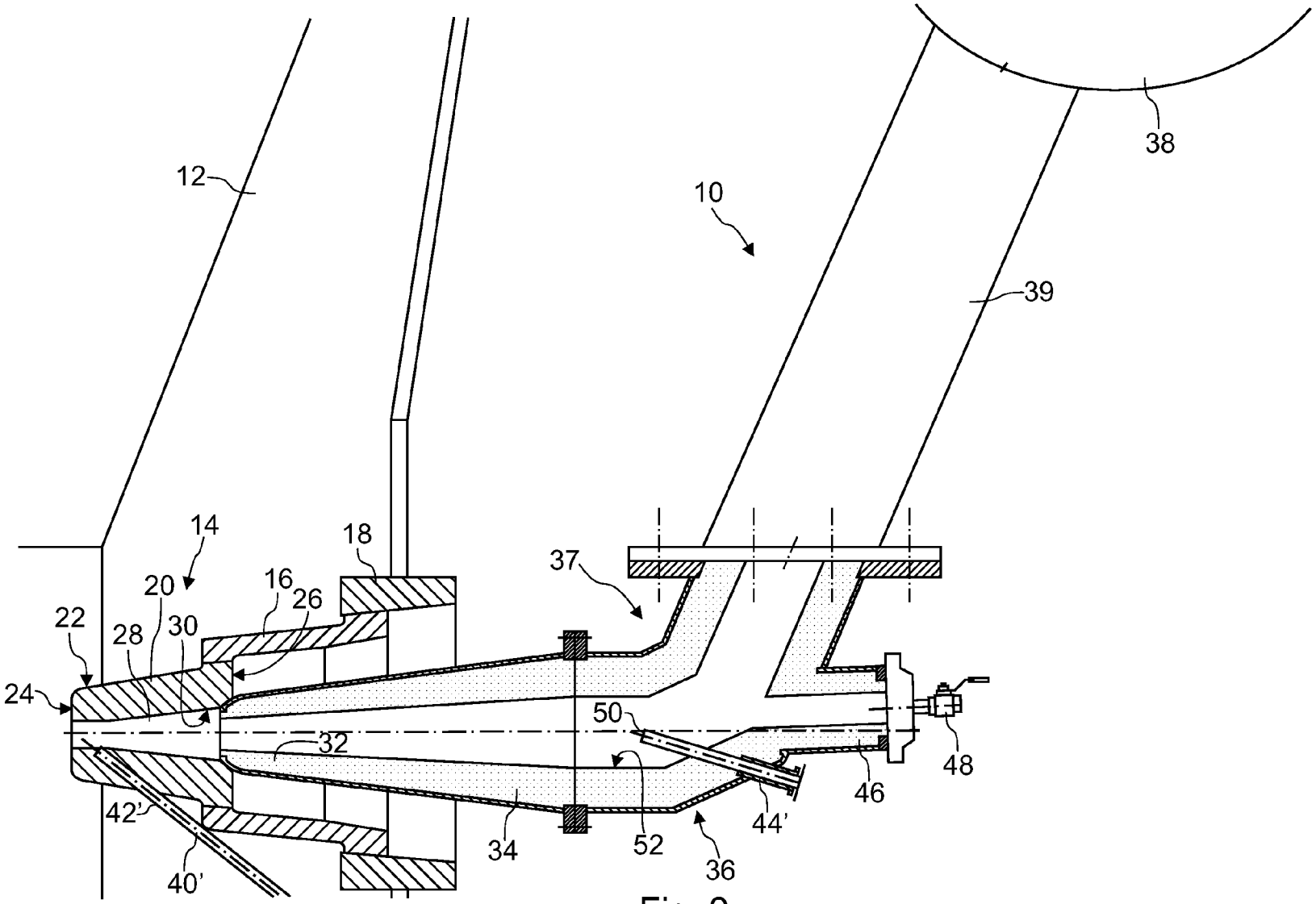
FIG. 2 is a schematic cut through a tuyere stock arrangement according to another embodiment of the present invention.

FIG. 2 shows a second embodiment of the present invention, with an alternative arrangement for the fuel injection lance 40 and an alternative arrangement for the gas injection lance 44. Most of the features of this second embodiment are identical to the embodiment shown in FIG. 1 and will therefore not be explained in further detail herebelow. Identical references signs refer to identical features.

According to the embodiment shown in FIG. 2, the fuel injection lance 40' is arranged in a lance passage 42' formed in the tuyere body 20. Such a lance passage 42' extends at an angle from the outer wall 22 to the inner wall 30. The lance passage 42' thereby opens into the inner wall 30 of the tuyere body 20 and fuel is fed into the tuyere channel 28. The fuel injected into the tuyere channel 28 comes into contact with the oxidizing gas blown through the tuyere channel 28 and ignites within the tuyere channel 28.

According to the embodiment shown in FIG. 2, the gas injection lance 44' is inserted into the elbow 37 from below the extension 46. The orientation of the gas injection lance 44' is such that the flow direction of the oxidizing gas is directed towards the center of the flow of the hot blast air. This arrangement is such that the gas injection lance 44' does not cause an obstruction to the visual monitoring of the operating conditions through the tuyere channel 28.

If a peep sight is not required, the gas injection lance may also be fed directly through the extension 46. This would e.g. allow the gas injection lance to be coaxial with the blowpipe.

Figure 3:
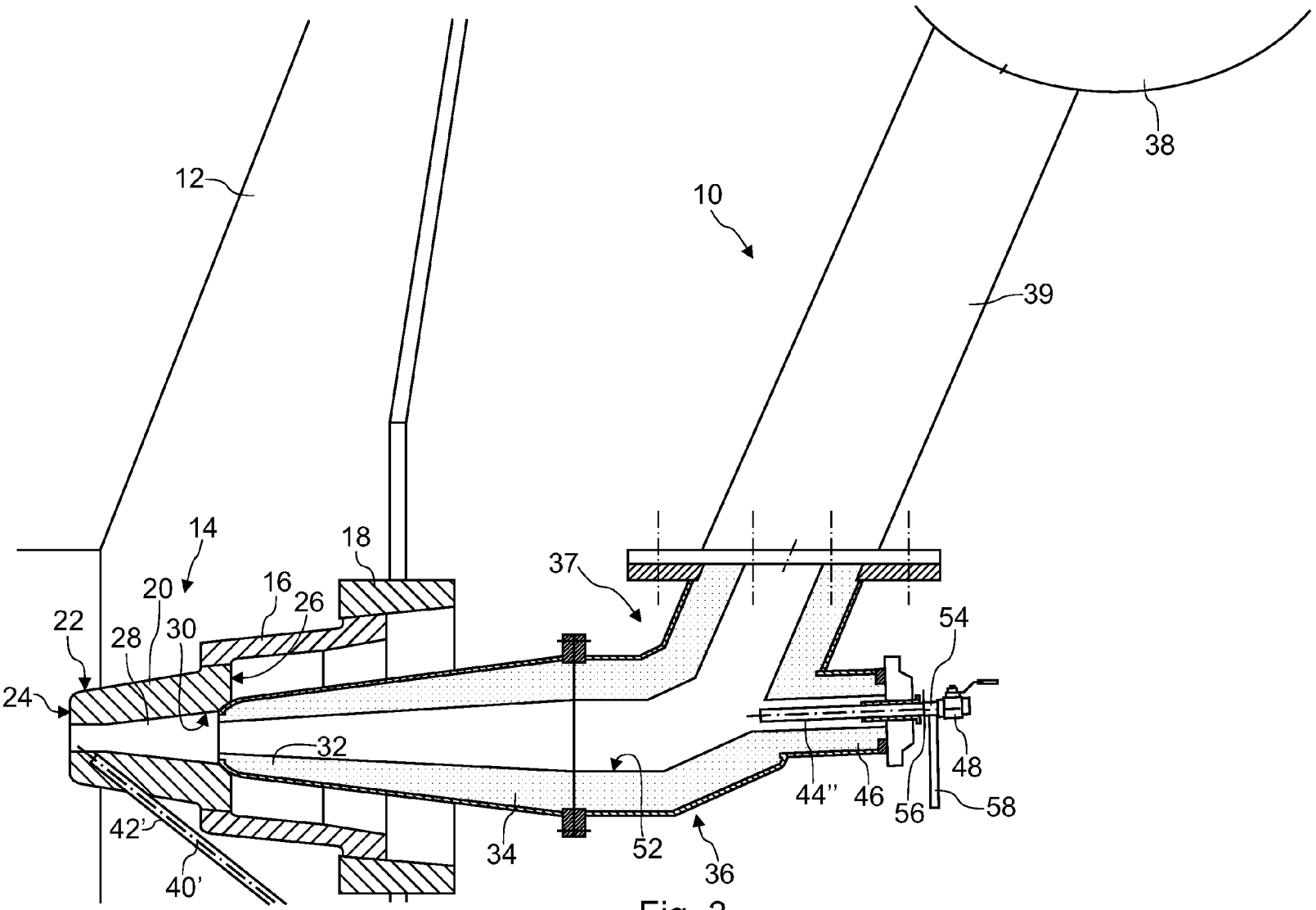
FIG. 3 is a schematic cut through a tuyere stock arrangement according to a further embodiment of the present invention.

FIG. 3 shows a third embodiment of the present invention, with an alternative arrangement for the gas injection lance 44. Most of the features of this third embodiment are identical to the embodiment shown in FIG. 2 and will therefore not be explained in further detail herebelow. Identical references signs refer to identical features.

According to the embodiment shown in FIG. 3, the gas injection lance 44" is inserted into the elbow 37 through the extension 46. The gas injection lance 44" is arranged such that it is parallel to and coaxial with a visual path between the peep sight 48 and the tuyere body 20. In other words, the visual path passes through the gas injection lance 44". At the end of the gas injection lance 44" proximate the peep sight 48, there is arranged a distribution chamber 54 with a lateral gas inlet 56 for feeding oxidizing gas to the gas injection lance 44". The distribution chamber 54 redirects the oxidizing gas from an oxidizing gas feed pipe 58 into the gas injection lance 44". As the oxidizing gas passes through the distribution chamber 54, it flows in front of the window of the peep sight 48, thereby keeping the window free from condensation and dust.

It should be noted that the alternative arrangement for the fuel injection lance 40 is in no way linked to the alternative arrangement for the gas injection lance 44. Indeed, fuel injection lance arrangement may be chosen completely independently from the gas injection lance arrangement. It should also be noted that the shown arrangements for the fuel injection lance 40, 40' and the gas injection lance 44, 44' are not intended to be exhaustive.

The invention claimed is:

1. A tuyere stock arrangement of a shaft furnace, said tuyere stock arrangement comprising:

a tuyere body configured for installation in a shaft furnace wall said tuyere body comprising a front face facing an interior of said shaft furnace and an opposite rear face, a tuyere channel extending from said rear face to said front face;

a blowpipe connected between said rear face of said tuyere body and a hot blast air supply system, said blowpipe having a front portion connecting to said tuyere body and an opposite rear portion connecting to said hot blast air supply system;

a fuel injection lance for feeding fuel into said shaft furnace, said fuel injection lance being arranged through said tuyere body; and a gas injection lance for feeding an oxidizing gas to said shaft furnace wherein said gas injection lance is arranged in said rear portion of said blowpipe, said gas injection lance being arranged in such a way as to feed said oxidizing gas into a central portion of a stream of hot blast air fed through said blowpipe.

2. The tuyere stock arrangement according to claim 1, wherein said hot blast air supply system comprises a hot blast bustle pipe and a downleg for connecting to said blowpipe; and wherein said blowpipe comprises an elbow at its rear portion, said elbow connecting said blowpipe to said downleg.

3. The tuyere stock arrangement according to claim 2, wherein said gas injection lance is arranged in said elbow.

4. The tuyere stock arrangement according to claim 2, wherein said elbow comprises an extension in axial alignment with said blowpipe, a peep sight being arranged at an end portion of said extension.

5. The tuyere stock arrangement according to claim 4, wherein said gas injection lance is arranged in such a way as not to obstruct a visual path between said peep sight and said tuyere body.

6. The tuyere stock arrangement according to claim 4, wherein said gas injection lance is arranged parallel to and coaxial with a visual path between said peep sight and said tuyere body, said visual path passing through said gas injection lance, wherein said gas injection lance comprises a lateral gas inlet for feeding oxidizing gas to the gas injection lance.

7. The tuyere stock arrangement according to claim 1, wherein said fuel injection lance is arranged through said tuyere body so as to feed fuel into said tuyere channel, said fuel injection lance opening into a side wall of said tuyere channel.

8. The tuyere stock arrangement according to claim 1, wherein said fuel injection lance is arranged through said tuyere body so as to feed fuel into said blast furnace, said fuel injection lance opening into said front face of said tuyere body.

* * * * *